US006563908B1

(12) United States Patent
Enck, Jr.

(10) Patent No.: US 6,563,908 B1
(45) Date of Patent: May 13, 2003

(54) HIGH RELIABILITY HIGH VOLTAGE DEVICE HOUSING SYSTEM

(75) Inventor: Richard S. Enck, Jr., San Jose, CA (US)

(73) Assignee: Kevex X-Ray, Inc., Scotts Valley, CA (US)

( * ) Notice: Subject to any disclaimer, the term of this patent is extended or adjusted under 35 U.S.C. 154(b) by 0 days.

(21) Appl. No.: 09/438,169

(22) Filed: Nov. 11, 1999

(51) Int. Cl.[7] ..... H01J 35/20
(52) U.S. Cl. ..... 378/123; 378/121
(58) Field of Search ..... 378/123, 121, 378/125, 127, 119; 313/547; 361/220; 374/51

(56) References Cited

U.S. PATENT DOCUMENTS 4,964,148 A * 10/1990 Klostermann et al. ..... 378/121
5,696,808 A * 12/1997 Lenz ..... 378/121
5,947,758 A * 9/1999 Enck ..... 439/181
6,252,933 B1 * 6/2001 Artig ..... 378/121

* cited by examiner

*Primary Examiner*—Drew A. Dunn
*Assistant Examiner*—Iraki Kiknadze
(74) *Attorney, Agent, or Firm*—Benman, Brown & Williams

(57) ABSTRACT

A high voltage device housing assembly includes a housing and a high voltage assembly arranged in combination with an improved insulation system. The high voltage assembly is disposed within the enclosure defined by the housing, and the outer surface of the high voltage device, such as a vacuum tube, bears an insulator including a first portion generally continuously covering the side surface of the high voltage and an integral second portion comprising a plurality of spaced apart projections extending around the side surface and between the first portion and the inner wall of the housing. Air gaps are present between the respective projections, and the spacing of the ribs is established in a manner that inhibits ionic conduction from occurring between the housing and the high voltage device, which otherwise could lead to high voltage breakdowns.

23 Claims, 3 Drawing Sheets

HIGH RELIABILITY HIGH VOLTAGE DEVICE HOUSING SYSTEM

BACKGROUND OF THE INVENTION

1. Field of the Invention

The present invention relates generally to the field of high voltage component housing systems, and more specifically to the encapsulation of high voltage vacuum devices within housings in an improved manner.

2. Description of the Related Art

Many high voltage devices, such as vacuum tubes, high voltage resistors, and high voltage capacitors, that operate at high voltage in high voltage component systems require specialized housing methods to provide the necessary high voltage insulation of the high voltage devices, the interface to power supplies, and/or to mounting surfaces for subsequent use in systems. Additionally, such housing systems must often remove heat due to high temperatures generated by operation of the high voltage device. For instance, conventional x-ray tubes, such as those illustrated in U.S. Pat. Nos. 5,751,784 and 5,563,923, typically include a sealed glass or ceramic vacuum tube containing the x-ray generating means, which requires appropriate insulating, cooling and shielding.

To achieve the above-mentioned insulation and thermal handling objectives, one type of conventional housing system used for vacuum tubes involves filling the housing with high dielectric strength, high purity oil into which the vacuum tube is submerged. For instance, for vacuum x-ray tubes, Diala or another comparable high dielectric strength oil has been filled into an outer housing, and the vacuum x-ray tube is submerged in the oil. For such vacuum x-ray tube assemblies, a diaphragm also is typically placed between the exposed surface of the oil and the air outside the outer housing for sealing purposes and so that the oil can expand from heating without applying stress to the vacuum x-ray tube.

Oil systems of this type for vacuum tubes have been popular due to the relative simplicity in implementation. If proper cleanliness, elimination of air voids, and room for expansion of the oil during heating is provided, the oil systems can provide excellent high voltage insulation with good heat coupling to the housing. Oil systems also permit easy removal of the vacuum tube, if necessary due to manufacturing, test or operational problems, by simply draining the oil and replacing the vacuum tube with another, followed by refilling the oil.

However, drawbacks are associated with the oil systems in practice. The use of the liquid oil requires care to avoid becoming untidy and messy. Oil also can leak from the housing over time. Additionally, the oil can become contaminated, or degraded due to temperature and pressure fluctuations associated with the operation of the vacuum tube. As a result, risk of failures from high voltage arcing, leakage and breakdown tend to increase over time for the liquid oil-based systems.

Therefore, as an alternative to oil, a silicone rubber resin has been used for potting the housing with an internally mounted vacuum tube. Namely, room temperature vulcanizing (RTV) silicone rubber has been used for vacuum x-ray tube assemblies to displace all the air otherwise present in the gap provided between a vacuum tube and its housing. A curable liquid RTV silicone rubber is poured in a liquid state inside the housing to directly contact its inner walls. The vacuum tube is submerged in the silicone rubber such that the silicone rubber completely fills the gap between the exterior surface of the vacuum tube and the inner walls of the housing. Once the RTV rubber is cured, the housing, vacuum tube and intervening silicon rubber form a unitary assembly. Once the RTV rubber is cured, such housing systems are often very stable with adequate insulation and thermal conduction properties. The cured silicone rubber does not leak from the housing. Like oil systems, silicone rubber systems generally are reliable for many implementations.

However, a drawback to using potting silicone resins in the above-stated conventional manner derives from the fact that a defective vacuum tube cannot be serviced or replaced without considerable difficulty since the cured potting material is adhesively bonded to not only the vacuum tube but also the housing, and thus it is not easily detached and removed from the housing.

It would be desirable to be able to provide a vacuum tube housing system that has all of the advantages of silicone rubber potting systems while permitting easier, more convenient removal and/or replacement of the vacuum tube from a housing.

SUMMARY OF THE INVENTION

According to the present invention, a high voltage device housing assembly includes a housing and a high voltage device assembly arranged in combination with an improved insulation system which effectively prevents high voltage breakdown while permitting easy and convenient installation, removal and/or replacement of the high voltage device from its housing.

In one embodiment, a vacuum tube housing assembly of this invention includes a housing having an inner wall defining an enclosure into which a vacuum tube assembly is inserted. The vacuum tube assembly includes a vacuum tube having a outer side surface bearing an insulator, where the insulator includes a first portion generally continuously covering the outside surface of the vacuum tube and an integral second portion comprising a plurality of spaced apart projections or ribs extending around the outside surface and between the first portion and the inner wall of the housing. Air gaps are present between the respective projections or ribs, and the spacing of the ribs is established in a manner that inhibits high voltage breakdowns from occurring between the interface of the housing and the vacuum tube.

In one advantageous embodiment, the insulator used in the inventive vacuum tube housing assembly is formed from a curable silicon rubber molded in situ upon the exterior surface of the vacuum tube. The silicone rubber is molded and cured in place in a manner providing a series of spaced apart, raised circular ribs in the resulting rubber encapsulant formed upon the vacuum tube surface. This ribbed configuration of the rubber encapsulant formed upon the vacuum tube permits the resulting pre-potted vacuum tube to be properly positioned within the housing such that the spaced apart ribs physically engage the inner wall of the housing to form seal zones that alternate with intervening air gaps created between adjoining ribs and the inner wall of the housing. The resulting silicone rubber pre-potted vacuum tube assembly is endowed with high voltage insulation for high voltage connections within the housing. Moreover, the inventive pre-potted vacuum tube structure can be easily plugged into its housing and just as easily removed, if necessary, because the rubber encapsulant is not adhered to the housing, thereby greatly improving the manufacturability and serviceability of housed vacuum tubes. Furthermore, the rib features of the rubber encapsulant also serve to thermally couple heat from the vacuum tube to the housing.

Although the present invention is especially well-suited for implementation in vacuum x-ray tube assemblies, it is by no means limited thereto and has general applicability to housed high voltage components, including, for instance, high voltage resistors and high voltage capacitors. The present invention also is directed to a method of making the high voltage device housing assembly.

DESCRIPTION OF THE INVENTION

Illustrative embodiments and exemplary applications will now be described with reference to the accompanying drawings to disclose the advantageous teachings of the present invention.

Figure 1:
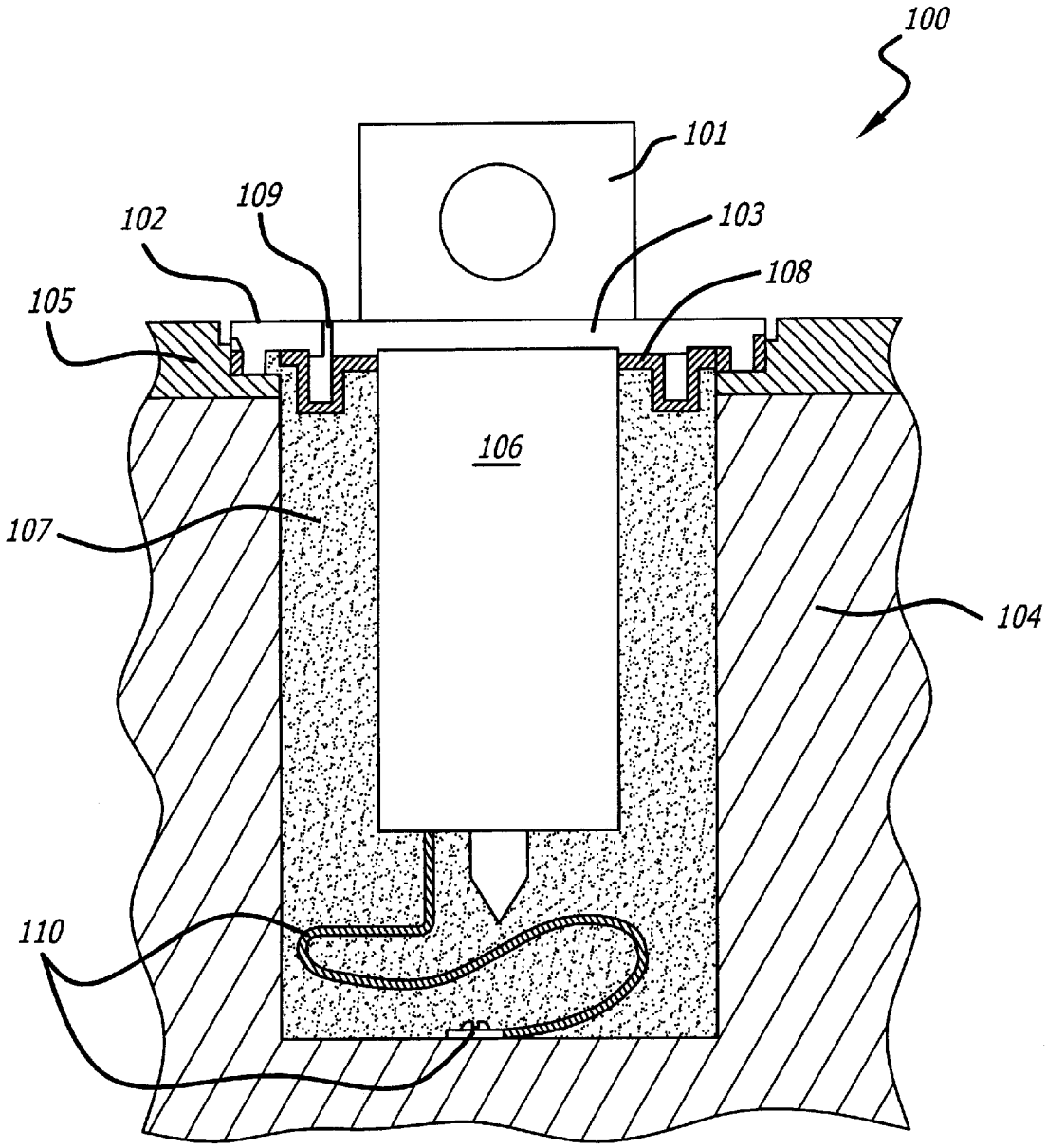
FIG. 1 (Prior Art)
FIG. 1 is a sectional view of a prior art packaged x-ray tube assembly.

FIG. 1 illustrates a prior art packaged x-ray tube assembly 100 that employs an anode assembly 101 that is mounted with screws 102 through the mounting screw holes provided in the anode flange 103 to the epoxy housing 104 via the assembly mounting flange 105. This mounting is done so as to provide a leak-tight reservoir between the vacuum tube 106 and the housing 104 that retains Diala insulating oil 107. The seal means of the anode flange 103 to the assembly mounting flange 105 is a rubber oil expansion diaphragm 108 that seals in the oil 107 and also permits for oil expansion when the oil 107 becomes hot during operation of the packaged tube assembly 100. The expansion occurs by virtue of the vent hole 109 which allows air to escape which in turn permits the diaphragm 108 to collapse in response to the expanding oil 107. High voltage and electron gun power are provided to the vacuum tube 106 by means extending through the oil 107 via various high voltage connections 110, thus enabling the application of high voltage and filament current in a conventional electron gun assembly (not shown) enveloped within the vacuum tube 106 during operation of the device 100. Further details on the construction and operation of the packaged x-ray tube assembly 100 shown in FIG. 1 are provided in U.S. Pat. No. 4,646,338, which teachings are incorporated herein by reference. An alternative to the approach shown in FIG. 1 involves replacing the use of liquid oil 107 with complete silicone encapsulation filling all space between the housing 104 and the vacuum tube 106. The system shown in FIG. 1 is unaltered for this alternative except for the possible elimination of the oil expansion diaphragm 108 in lieu of alternatives permitting for expansion of the solid rubber encapsulation when the assembly 100 becomes hot during its operation.

The fundamental weaknesses associated with the prior art vacuum tube housing assembly 100 of the type shown in FIG. 1 depends on whether oil or silicone rubber is used to completely encapsulate the vacuum tube. With oil, it very difficult to assemble the package so that the oil remains clean, void free, and sealed against leakage. Additionally, if the vacuum tube fails to meet system level specifications in the housing, it is an untidy, messy and difficult process to remove the tube for retesting. With complete silicone rubber encapsulation, as with oil, keeping the rubber clean and void free is also critical during the encapsulation process (normally the cavity is filled under vacuum pumping). The silicone rubber has the advantage of not leaking after completion of the curing process. However, if the vacuum tube fails the assembly test, it is virtually impossible to remove the tube from the housing to which it is adhered since the cured rubber is extremely tough and adheres tenaciously to all contacted surfaces within the housing well.

Figure 2:
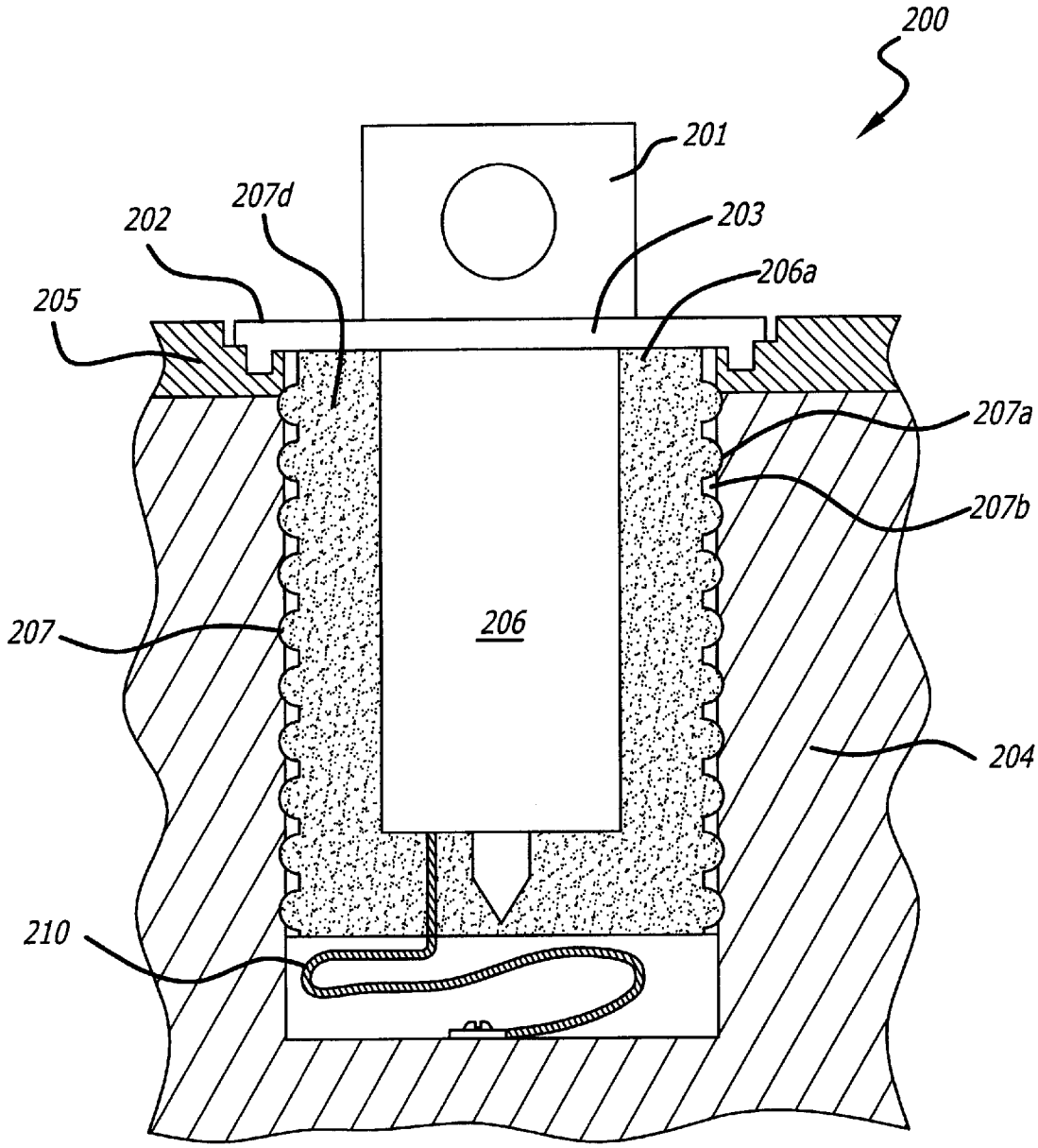
FIG. 2 is a sectional view of a packaged x-ray tube assembly of the present invention.

FIG. 2 shows a vacuum x-ray tube housing assembly 200 according to the present invention which avoids and overcomes the aforementioned problems and drawbacks of the conventional insulation systems for such structures. Vacuum tube 206 and epoxy housing system 204 are shown having similar construction to that of FIG. 1. However, in this case the vacuum tube 206 is encapsulated first in the RTV potting silicone rubber 207 in a manner that creates a ribbed encapsulant configuration on the exterior of the vacuum tube as shown. Additionally, high voltage connections 210 are provided before potting with the silicone rubber, and are thus encapsulated by the silicone rubber at the same time that the ribbed configuration is achieved. The rubber-encapsulated vacuum tube 206 is then assembled into the epoxy housing 204 by screws 202 connected to the assembly mounting flange 205 through mounting screw holes provided in the anode flange 203 of anode assembly 201. The vacuum x-ray tube 206 is powered in the same way as shown in the scheme of FIG. 1.

By providing encapsulation of the vacuum x-ray tube by a silicon rubber configured in a ribbed cylindrical shape, oil is eliminated totally along with enabling the use of silicone rubber in a form where removal (and even replacement) of the vacuum tube 206 from the housing 204 is easily accomplished. Furthermore, there is no need for special provision for expansion as the space between the projection or rib features 207*a* of potting material 207 provides ample expansion space.

To manufacture the vacuum tube housing assembly of the invention, the vacuum x-ray tube 206 is encapsulated, i.e., "potted", in situ with a low-consistency room temperature vulcanizing (RTV) elastomer material using a mold. Preferably, the mold is a two-piece casting mold. In the case of using casting techniques to encapsulate the vacuum tube 206 with insulating potting material, the vacuum x-ray tube is the insert that is surrounded by a suitable surface-contoured polymeric matrix selected to provide the desired thermal and electrical insulation described herein. Typically, the vacuum tube 206 is a glass material. The mold used has an inner surface having indentations matching and complementary to the rib configurations 207*a* desired to be formed in the potting material 207. Otherwise, the mold presents a smooth inner surface facing the exterior side surfaces across a gap sized to form the desired transverse thickness of a non-ribbed inner solid portion 207*b* of the encapsulant rubber 207. Preferably, the inner surface of the mold used contains or is lined with a release material, such as a polytetrafluoroethylene (e.g., TEFLON), or another conventional mold release material suitable for releasing cured silicone elastomers.

The curable silicone elastomeric polymers useful as the potting (encapsulant) material 207 for the practice of this invention generally are based on polymeric chains featuring an alternating combination of silicon and oxygen atoms in the backbone and a variety of organic side groups attached to the silicon atoms that are selected depending on the properties desired. Low-consistency RTV elastomers suitable for practicing this invention generally involve low-molecular weight polysiloxanes (silicone) and generally rely on reactive end-groups for cross-linking (cure) at room or higher curing temperatures. Preferably, the curable silicone rubber is formulated so that the cured silicone rubber has enhanced thermal conductivity. In an advantageous embodiment in this regard, the RTV rubber material is filled with thermally conductive powder material of low electrical conductivity, such as alumina or the like, in an amount sufficient to promote heat conduction through the cured silicone rubber from the vacuum tube to the outer housing, yet without adversely affecting the electrical insulating and dielectric properties required of the silicone rubber.

The RTV silicone rubber used can be a so-called one-part system relying on atmospheric moisture for curing, or a so-called two-component system using a catalyst requiring a mixing stage before pouring and curing. In any event, the RTV silicone potting material used is a flexible thermosetting material that is a viscous yet flowable liquid prior to curing. It can be SYLGARD products made by Dow Corning, or comparable RTV silicone products made by Rhone Poulenc or other silicone rubber makers. The gelation time, i.e., the time at which the silicone resin system selected ceases to be fluid, must be sufficiently long enough to permit complete pouring into and filling of the mold cavity without leaving air pockets.

Additionally, the exterior surface 206*a* of the vacuum x-ray tube 206 preferably is coated and conditioned with a primer before the potting material 207 is poured into the cavity formed between the surface of the vacuum tube and the inner walls of the mold. Conventional primer systems used for bonding silicone elastomers to glass can be used in this regard, such as silane based systems, which are illustrated in U.S. Pat. No. 4,719,262, or silanol based systems, such as described in U.S. Pat. No. 5,378,535. Sufficient potting material 207 is poured into the mold to completely fill the cavity to continuously and uniformly coat the exterior surface of the vacuum tube and fill the recesses in the mold. As noted above, the mold preferably is a two-piece casting mold assembly. In this way, the mold can be easily removed from the potting material after the latter has been poured and cured in place upon the vacuum tube 206. Although the potting material is a RTV material, and thus can be cured at room temperature if sufficient time is permitted, preferably the curing is accelerated by placing the mold assembly in a temperature-controlled air oven after the silicone is poured into the cavity. In this way, the ribbed potting material 207 is integrally formed upon the exterior surface of the vacuum x-ray tube 206. Once the ribbed potting material sets up, the mold is removed, and the potting encapsulated-vacuum tube can be installed in the housing 204 by the means described above.

Figure 3:
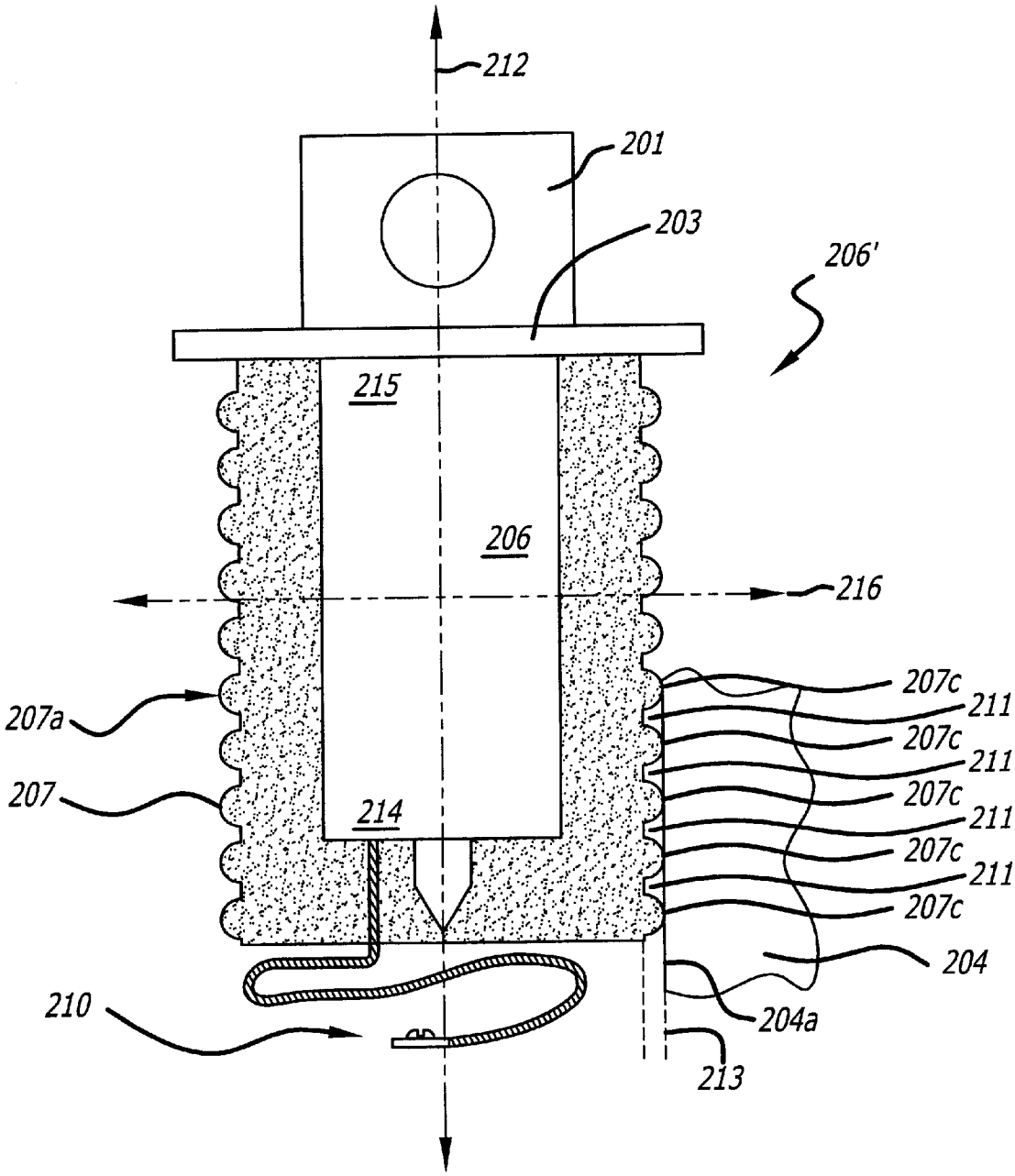
FIG. 3 is a sectional view of a portion of the packaged x-ray tube assembly of the present invention shown in FIG. 2.

As can be more clearly seen in FIG. 3, this invention includes the unique configuration of the encapsulated x-ray tube designated as the potted vacuum tube assembly 206', including a unitary assembly comprised of the vacuum tube 206 (as combined with anode assembly 201) with the vacuum tube 206 encapsulated with the ribbed rubber 207. The series of potting ribs 207*a* shown in FIG. 3 create a plurality of seal zones 207*c* where abutted against the inner wall 204*a* of housing 204 and define intervening air gaps 211 that provide high voltage insulation capability in a form where the potted vacuum tube assembly 206' can be easily removed and replaced. The seal zones 207*c* are intended to create intimate contact between the potting ribs 207*a* and the respective adjacent housing material 204*a*. To facilitate this, the combined thickness of the non-contoured inner portion 207*d* (see FIG. 2) and the ribbed outer portion 207*a* of the encapsulant rubber 207 are selected and provided to create a slight compression by engagement of the ribs 207*a* against the inner wall 204*a* of the housing 204 to form the seal zones 207*c* which seal off the intervening air gaps 211. However, the rib compression provided cannot be so great as to substantially reduce the projection of the ribs 207*a* and thereby effectively eliminate the intervening air gaps 211. Thus, a lateral clearance gap 213 is provided between the exterior side surface 206*a* of vacuum x-ray tube 206 and the inner surface 204 of housing 204 which permits such an insertion (or retraction) of the vacuum tube 206 into (or out of) the housing well and frictional engagement with the inner housing wall 204*a*.

A light coating of grease can optionally be applied to the inner surface 204*a* of the housing 204 to ensure this sealing arrangement in case the confronting surfaces are not perfectly smooth. The grease, if used, also serves to ease the insertion, and, removal of the potted vacuum tube assembly 206' from the housing 204. The ribs 207*a* are generally symmetric circular or oval ring shapes, or the like, and they project outward towards and into contact with the inner wall 204*a* of the housing 204 in a transverse (lateral) direction 216. The transverse (lateral) direction 216 is oriented generally perpendicular to the longitudinal (major lengthwise) axis 212 of the vacuum tube 206 (and housing 204). Where the vacuum tube 206 has a generally rounded or circular cross-sectional profile, the inner wall 204*a* of the housing 204 will define a generally similar cross-sectional shape in geometry, except in larger dimension.

Referring still to FIG. 3, another aspect of this invention is that the seal zones 207*c* are spaced apart from each other, along the direction of the longitudinal axis 212, according to a prescribed protocol in order to maximize the insulating properties imparted by the encapsulant rubber. Although there is no appreciable high voltage field gradient in the above-mentioned clearance gap 213 itself, the clearance may be a catalyst for high voltage breakdowns in the device. Ordinarily, a high voltage (e.g., 50–160 KV) exists at the exterior surface 206*a* of the vacuum x-ray tube 206 on account of the high voltage connection 210 made to the vacuum tube 206 at one longitudinal end 214 thereof while a zero voltage (ground potential) exists at the assembly mounting flange 205 near the opposite longitudinal end 215 of the vacuum tube 206. Due to this high voltage gradient, any air in the clearance gap 213 between the vacuum tube 206 and the housing 204 will become ionized. This ionization will eventually lead to a high voltage breakdown unless appropriate contingency measures are implemented. Namely, the high voltage gradient will ionize any air in the gaps 211 and ultimately can lead to high voltage breakdowns. As these high voltage breakdowns occur, a carbon residue is left on the exposed sides of the housing and vacuum tube. The carbon residue will promote further arcing and high voltage leakage between the vacuum tube 206 and the housing 204. The arcing and high voltage leakage would steadily worsen and ultimately can cause a system failure by shorting out the high voltage power supply means 210 to the vacuum x-ray tube 206.

To inhibit such ionization of the air in the clearance gap 213 (in air gaps 211), the previously mentioned conventional uses of oil or silicone rubber to completely fill and displace all the air in the clearance gap have been practiced, but these prior approaches suffer from the drawbacks noted above. By contrast, the present invention effectively inhibits the ionic conduction phenomenon without the drawbacks of the prior art.

To accomplish this, the present invention prevents the air in the clearance gap 213 (in air gaps 211) between the vacuum tube 206 and the housing 204 from ionizing by effectively dividing the high voltage gradient residing in the clearance gap 213 into discrete segments of lower voltage. Referring still to FIG. 3, the typical high voltage gradient between any two similar points located at adjacent seal zones 207*c* is approximately 10 KV under maximum operating and test voltage conditions. This voltage is presented across a seal zone/air gap width measured as the distance across a seal zone 207*c* and an adjacent air gap 211 in the longitudinal direction 212 typically several mm. The seal zone 207*c* width is typically about 1 mm due to the compressions of the ribs 207*a* determined by the dimensions of the ribs 207*a* and the housing 204. When the voltage is so presented, it is divided between the seal zone 207*c* and the air gap 211. The division of potential is determined by the relative electronic resistance of the air gap 211 and the seal zone 207*c* akin to a simple voltage divider. The resistance of the seal zone 207*c* is determined by the bulk resistance of the silicone rubber 207 in the seal zone 207*c* and is quite stable under most environmental conditions. Typically, this resistance is in the order of $10^{12}$ ohms and varies less than one order of magnitude (<X10). However, the resistance of the air gap 211 varies substantially with temperature, pressure, and voltage. If the resistance of the air gap 211 and the seal zone 207*c* are equal, then 5 KV exists across each. As conditions change, the air gap voltage can vary from as little as zero volts to as much as the full 10 KV, although each extreme is unlikely. Likewise, the voltage across the seal zone 207*c* will vary inversely with that of the air gap 211 within the same limits. The seal zone width is so established as to enable the full 10 KV potential to exist across the seal zone 207*c* without high voltage failure occurring. As noted above, typical seal zone width is about 1 mm which will withstand about 20 KV at the breakdown strength of the silicone rubber of typically 500 volts per thousandth of an inch.

As an illustration of these precepts, the number of projections or ribs 207 is preferably selected to produce approximately 10 KV of potential between each adjacent seal zone 207*c*, as indicated above. Hence, a 125 KV system would use 12 or 13 equally spaced ribs 207*a*. Again, this 10 KV potential is divided between the air gaps 211 (located between the seal zones 207*c*) and the seal zones 207*c*. That is, the number "n" of projections (ribs 207*a*) being chosen so that a voltage potential between any two adjacent projections ($V_s$) is below an ionic conduction breakdown potential for each projection given the voltage potential V between the first and second points 214 and 215 of vacuum tube 206. It follows that the preferred voltage potential between any two adjacent projections ($V_s$) is approximately V/n.

The essence of the high voltage integrity of this invention lies in the fact that under any division of potential between the seal zone 207*c* and the air gap 211, there can be no high voltage failure. As described above, the seal zone 207*c* will not fail since it is designed with.a high safety factor. Additionally, the insulating system compensates automatically to prevent damaging ionization of the air gap 211 since the resistance of the seal zone 207*c* is not sufficient to support ionization in the air gap 211. Instead, the air gap 211 voltage simply lowers (as the seal zone voltage simultaneously increases) to a point below the ionization potential. This effect occurs due to the above described voltage divider effect combined with the fact that the air gap 211 resistance fails dramatically at the point where ionization occurs. Furthermore, a second unique advantage of this approach is that each of the other seal zone/air gap regions shown behaves identically to the above-described example. This is so since all seal zones are configured identically, as are all air gaps. Hence, all seal zones/air gap regions experience the same overall voltage and the same operating conditions. Accordingly, a key feature of this approach is that the assembly of the ribbed potted tube in the housing is not subject to failure due to any type of high voltage breakdown along the entire high voltage interface.

The arrangement of the seal zones/air gap regions is based generally on protocols and concepts described in and derived from Applicant's co-pending U.S. application Ser. No. 08/916,022, which teachings are incorporated herein in by reference in their entirety for all purposes.

Another advantageous feature of this invention is the fact that the air gaps 211 provided adequate space to accommodate expansion of the silicone rubber 207 as the assembly heats during operation without the need for any other means of expansion. This fact greatly simplifies the overall design since no diaphragms or separate expansion zones are necessary.

Yet another advantageous feature of the present invention is that the ribbed potted vacuum tube can be easily removed from the housing assembly without harming the potting or the housing. This enables test, evaluation, and processing of the vacuum tube independent of the housing structure followed by simple reassembly by reinserting the ribbed potted tube into the housing.

While the present invention is described herein with reference to illustrative embodiments for particular applications, it should be.understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications could be made within the scope thereof. While the invention has been illustrated above in connection with a vacuum tube housing assembly, it will be understood that the invention is not limited to vacuum tubes as the high voltage device to be housed and insulated according to the techniques of this invention. For example, the high voltage device also could be a high voltage resistor. Also, although illustrated above as an epoxy material construction, the housing can be made of any material having suitable structural rigidity and insulating properties.

It is therefore intended by the appended claims to cover any and all such applications, modifications and embodiments within the scope of the present invention.

Accordingly,

What is claimed is:

1. A high voltage device housing assembly, comprising:

a housing having an inner wall defining an enclosure and a high voltage device assembly, disposed within the enclosure, including a high voltage device, said device being a vacuum tube, having an outside surface bearing an insulator, wherein said insulator comprises silicone rubber and the insulator includes a first portion generally continuously covering the outside surface of the high voltage device and an integral second portion comprising a plurality of spaced apart projections extending around the outside surface and between the first portion and the inner wall of the housing.

2. A high voltage device housing assembly, comprising:

a housing having an inner wall defining an enclosure and a high voltage device assembly, disposed within the enclosure, including a high voltage device having an outside surface bearing an insulator, wherein said insulator comprises silicone rubber and the insulator includes a first portion generally continuously covering the outside surface of the high voltage device and an integral second portion comprising a plurality of spaced apart projections extending around the outside surface and between the first portion and the inner wall of the housing wherein air gaps are present between the plurality of projections.

3. A high voltage device housing assembly, comprising:

a housing having a rigid cylindrical shape and an inner wall defining an enclosure and a high voltage device assembly, disposed within the enclosure, including a high voltage device having an outside surface bearing an insulator, wherein said insulator comprises silicone rubber and the insulator includes a first portion generally continuously covering the outside surface of the high voltage device and an integral second portion comprising a plurality of spaced apart projections extending around the outside surface and between the first portion and the inner wall of the housing.

4. A high voltage device housing assembly, comprising:

a housing having an inner wall defining an enclosure and a high voltage device assembly, disposed within the enclosure, including a high voltage device having an outside surface bearing an insulator, wherein said high voltage device is selected from the group consisting of a high voltage resistor and a high voltage capacitor and wherein said insulator comprises silicone rubber and the insulator includes a first portion generally continuously covering the outside surface of the high voltage device and an integral second portion comprising a plurality of spaced apart projections extending around the outside surface and between the first portion and the inner wall of the housing.

5. A high voltage device housing assembly, comprising:

a housing having an inner wall defining an enclosure and a high voltage device assembly, disposed within the enclosure, including a high voltage device having an outside surface bearing an insulator, wherein said high voltage device has means for providing a voltage potential (V) between a first point located at a first longitudinal end of said high voltage device and a second point located at a second longitudinal end of said high voltage device, wherein said insulator inhibits ionic conduction between the first and second points and wherein said insulator comprises silicone rubber and the insulator includes a first portion generally continuously covering the outside surface of the high voltage device and an integral second portion comprising a plurality of spaced apart projections extending around the outside surface and between the first portion and the inner wall of the housing.

6. A high voltage device housing assembly, comprising:

a housing having an inner wall defining an enclosure and a high voltage device assembly, disposed within the enclosure, including a high voltage device having an outside surface bearing an insulator, where the insulator includes a first portion generally continuously covering the outside surface of the high voltage device and an integral second portion comprising n spaced apart projections extending around the outside surface and between the first portion and the inner wall of the housing, where the number of projections n is chosen so that a voltage potential between any two adjacent projections ($V_s$) is below an ionic conduction breakdown potential for each projection given the voltage potential V between said first and said second points.

7. The high voltage device housing assembly according to claim 1, 3, 4 or 5 wherein air gaps are present between the plurality of projections.

8. The high voltage device housing assembly according to claim 1, 2, 4 or 5 wherein said housing comprises a rigid cylindrical shape.

9. The high voltage device housing assembly according to claim 1 wherein said outside surface of said vacuum tube comprises glass or ceramic.

10. The high voltage device housing assembly according to claim 1 wherein said vacuum tube and housing have a common longitudinal axis coinciding with respective geometric centers thereof, wherein the projections extend generally perpendicularly away from said longitudinal axis.

11. The high voltage device according to claim 1, 2, 3 or 5 wherein said high voltage device is selected from the group consisting of a high voltage resistor and a high voltage capacitor.

12. The high voltage device housing assembly according to claim 1, 2, 3 or 4 wherein said high voltage device has means for providing a voltage potential (V) between a first point located at a first longitudinal end of said high voltage device and a second point located at a second longitudinal end of said high voltage device, where said insulator inhibits ionic conduction between the first and second points.

13. The high voltage device housing assembly according to claim 2, 3, 4 or 5 wherein said high voltage device comprises a vacuum tube.

14. The high voltage device housing assembly according to claim 13 wherein said outside surface of said vacuum tube comprises glass or ceramic.

15. The high voltage device housing assembly according to claim 13 wherein said vacuum tube and housing have a common longitudinal axis coinciding with respective geometric centers thereof, wherein the projections extend generally perpendicularly away from said longitudinal axis.

16. A vacuum tube housing assembly, comprising:

a housing having an inner wall defining an enclosure and a vacuum tube assembly, disposed within the enclosure, including a high voltage vacuum tube device having means for providing a voltage potential (V) between a first point located at a first longitudinal end of said vacuum tube device and a second point located at a second longitudinal end of said vacuum tube device, and said vacuum tube device further comprising an outer side surface bearing an insulator, where the insulator includes a first portion generally continuously covering the side surface of the vacuum tube and an integral second portion comprising n spaced apart projections extending around the side surface and between the first portion and the inner wall of the housing for providing insulation against ionic conduction between said first and second points, where the number of projections n are chosen so that a voltage potential between any two adjacent projections ($V_s$) is below an ionic conduction breakdown potential for each projection given the voltage potential V between said first and said second points, and air gaps are present between the plurality of projections.

17. The vacuum tube housing assembly according to claim 16 or 6 wherein the voltage potential between any two adjacent projections ($V_s$) is approximately V/n.

18. The vacuum tube housing assembly according to claim 16 wherein said insulator comprises silicone rubber.

19. The vacuum tube housing assembly according to claim 16 wherein said housing comprises a rigid cylindrical shape.

20. The vacuum tube housing assembly according to claim 16 wherein said vacuum tube device comprises a vacuum x-ray tube.

21. The vacuum tube housing assembly according to claim 16 wherein said outer side surface of said vacuum tube device comprises glass or ceramic.

22. The vacuum tube housing assembly according to claim 16 wherein said vacuum tube device and housing have a common longitudinal axis coinciding with respective geometric centers thereof, wherein the projections extend generally perpendicularly away from said longitudinal axis.

23. The vacuum tube housing assembly according to claim 16 wherein the projections are annular ribs.

* * * * *